US005293670A

United States Patent [19]

Watanabe

[11] Patent Number: 5,293,670

[45] Date of Patent: Mar. 15, 1994

[54] TACK BUTTON

[75] Inventor: Hirokazu Watanabe, Kurobe, Japan

[73] Assignee: Yoshida Kogyo K.K., Tokyo, Japan

[21] Appl. No.: 984,288

[22] Filed: Dec. 1, 1992

Related U.S. Application Data

[63] Continuation of Ser. No. 737,726, Jul. 30, 1991, abandoned.

[30] Foreign Application Priority Data

Jul. 31, 1990 [JP] Japan ..... 2-81547

[51] Int. Cl.[5] ..... A44B 1/08

[52] U.S. Cl. ..... 24/90 R; 24/684

[58] Field of Search ..... 24/107, 108, 113 MP, 24/106, 104, 90 R, 94, 674, 683, 684, 685, 691

[56] References Cited

U.S. PATENT DOCUMENTS

| | | | |
|---|---|---|---|
| 1,295,109 | 2/1919 | Britt | 24/90 R X |
| 1,336,243 | 4/1920 | Lee | 24/108 |
| 1,359,038 | 11/1920 | Beaumont | 24/90 R X |
| 1,467,280 | 9/1923 | Warner . | |
| 4,033,012 | 7/1977 | Kramer et al. | 24/90 R |

FOREIGN PATENT DOCUMENTS

| | | | |
|---|---|---|---|
| 350530 | 1/1990 | European Pat. Off. | 24/94 |
| 3624006 | 6/1987 | Fed. Rep. of Germany . | |
| 8915363 | 6/1990 | Fed. Rep. of Germany . | |
| 1-177908 | 12/1989 | Japan . | |
| 2685 | of 1883 | United Kingdom | 24/90 R |
| 4469 | of 1890 | United Kingdom | 24/674 |
| 5074 | of 1896 | United Kingdom | 24/104 |

*Primary Examiner*—James R. Brittain

*Attorney, Agent, or Firm*—Hill, Steadman & Simpson

[57] ABSTRACT

A tack button is disclosed which comprises a button body having a cylindrical hub, a tack member and an anchoring member interconnecting the button body and the tack member. The cylindrical hub is resiliently supported to make a tilting movement relative to the plane of a garment fabric at both of its upper and lower marginal edges.

4 Claims, 2 Drawing Sheets

TACK BUTTON

This is a continuation of application Ser. No. 737,726, filed Jul. 30, 1991, now abandoned.

BACKGROUND OF THE INVENTION

1. Field of the Invention

This invention relates to a button having a button body and a tack member associated therewith for securing the button to a garment fabric such as student uniforms, jeans, sports wear and the like.

2. Prior Art

Numerous so-called tack buttons are known, some of which are designed to tilt or make free angular movement relative to the plane of a garment fabric to which the buttons are applied. A typical example of such prior art button is disclosed in Japanese Utility Model Laid-Open Publication No. 1-177908 and is illustrated in FIG. 5 of the accompanying drawing in which a button body 100 has secured thereto a disc-like collet 101 including a plurality of balancing retainer members 102. A shank 103 having a round head 104 is secured to a retainer 105 and is pierced through a fabric 106. The head 104 is supported in place on the balancing retainer members 102 so that the button can tilt with respect to the axis of the shank 103. This button device however is capable of only very limited tilting or angular movement with the results that the button is apt to disengage from or otherwise impair the fabric when the latter is subjected to pulling stresses. Another drawback is that the button is difficult to apply to a relatively thick garment fabric.

SUMMARY OF THE INVENTION

The present invention seeks to provide an improved tack button which will eliminate or alleviate the foregoing difficulties of the prior art and which incorporates such structural features that will permit the button to tilt with increased amount of movement at multiple locations so as to cope with relatively large external stresses.

According to the invention, there is provided a tack button which comprises: a button body having a button back and a cylindrical hub; a tack member; an anchoring member adapted to interconnect the button body and the tack member; and a spring member accommodated in the anchoring member and adapted to hold the cylindrical hub resiliently in place; the cylindrical hub having one marginal edge tiltably supported in the button back and the opposite marginal edge extending beyond the outer periphery of the hub and tiltably supported on the spring member.

The above features and advantages of the invention will appear clear from the following detailed description taken in connection with the accompanying drawings.

BRIEF DESCRIPTION OF THE DRAWINGS

FIG. 3 is a cross-sectional view of a prior art button shown applied to a garment fabric.

DETAILED DESCRIPTION OF THE INVENTION

Figure 1:
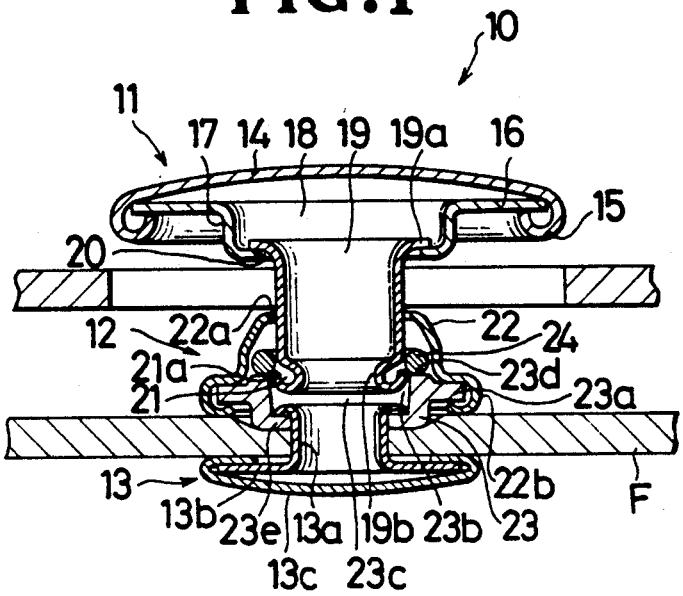
FIG. 1 is a cross-sectional view of a tack button of the invention shown applied to a garment fabric.

Referring now to the drawings and FIG. 1 in particular, there is shown a preferred form of tack button 10 embodying the invention which generally comprises a button body 11, an anchoring member 12 and a tack member 13. The button body 11 has a cap 14 folded peripherally inwardly to form an annular rim 15 to which a button back 16 is clamped in place. The button back 16 is downwardly bent or recessed to form a bulged portion 17 so as to create a chamber 18 between the cap 14 and the button back 16. The button body 11 includes a cylindrical hub 19 having its upper marginal edge **19*a* radially outwardly turned and loosely supported in the button back 16 through a central opening 20 thereof. The hub 19 is therefore freely movable relative to the cap 14 which in turn is disposed tiltably with respect to the plane of a garment fabric F. A lower marginal edge 19*b* of the hub 19 is folded radially outwardly to form an annular hook 21 with its extreme marginal edge 21*a* extending beyond the outer periphery of the hub 19**.

The anchoring member 12 is comprised of a casing 22 generally in the form of a truncated cone, a collet 23 and spring 24 in the form of an annular ring. The casing 22 has an upper aperture **22*a* dimensioned to receive but slightly larger in diameter than the hub 19 so as to allow the latter to move tiltably also at this location. A lower marginal end 22*b* of the casing 22 is folded inwardly around an annular peripheral flange 23*a* of the collet 23 to clamp the latter in place. The collet 23 has a central through opening 23*b* slightly diverging toward the hub 19 and dimensioned to loosely receive and allow the hook 21 to play in a space 23*c*. The collet 23 has at its upper end a flat horizontal surface 23*d* on which to support the annular spring 24. The collet 23 is turned radially inwardly at its lower end to form a peripheral ledge 23*e*. The spring 24 is slitted so that it can expand when mounted in surrounding relation to the hook 21 of the hub 19 and resiliently hold and permit the latter to make a tilting movement within the space 23*c* of the opening 23*b***.

The tack member 13 has a vertically extending tubular portion **13*a*, a radially outwardly extending flat portion 13*b* integral with the tubular portion 13*a* and a cover portion 13*c* having its marginal edge radially inwardly turned and folded over the flat portion 13*b*. The tack member 13, upon passing through the fabric F, is folded at its upper marginal edge radially outwardly over the ledge 23*e* of the collet 23 to join the tack member 13 with the collet 23**, thus holding the fabric F therebetween in sandwiched relation.

Figure 2:
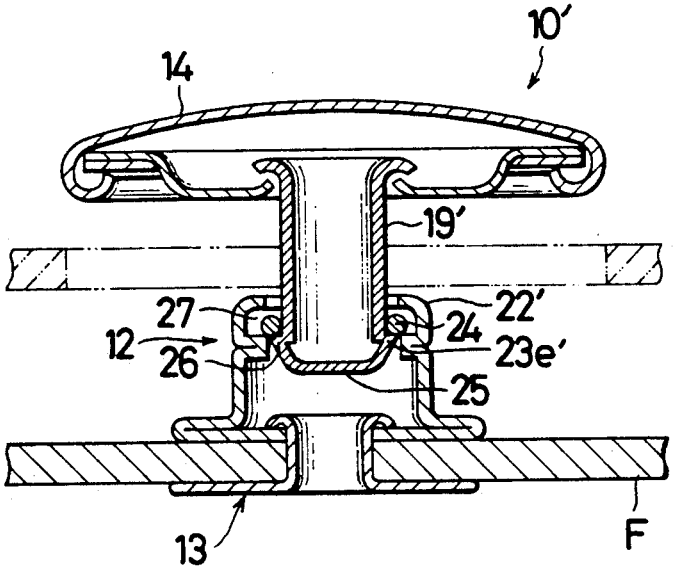
FIG. 2 is a cross-sectional view of a modified form of the inventive button.

FIG. 2 shows a modified form of button 10' according to the invention in which a cylindrical hub 19' is provided at its lower end with an inverted truncated cone portion 25 having an annular lug 26 extending beyond the outer periphery of the hub 19', the annular lug 26 playing the part of the annular hook 21 shown in FIG. 1. The modified button 10' includes a casing 22' having its upper marginal edge radially inwardly directed to form an annular cavity 27 with a flat horizontal surface **23*c'* on which to support the spring 24**. This arrangement precludes the necessity of providing a separate collet.

Figure 3:
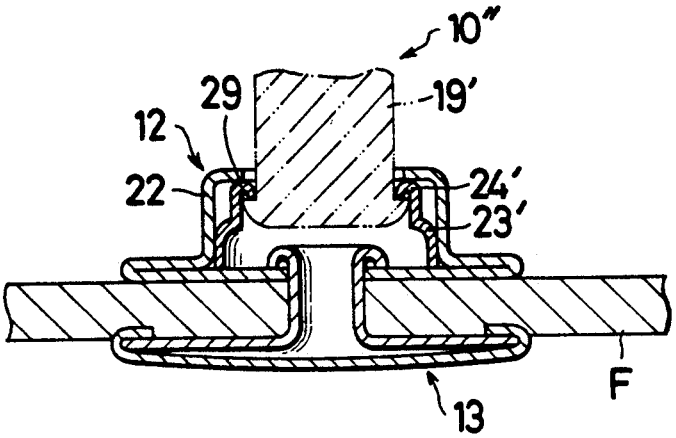
FIG. 3 is a cross-sectional view of another modified form of the button.
Figure 4:
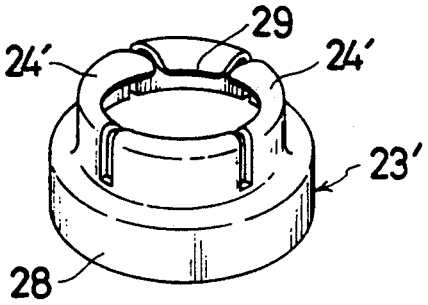
FIG. 4 is a perspective view of a portion of the button shown in FIG. 3.
Figure 5:
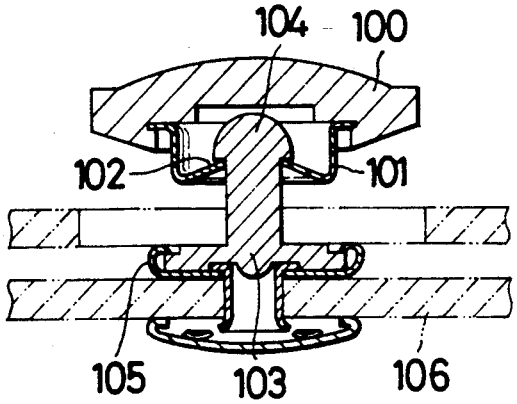
FIG. 5 PRIOR ART

FIGS. 3 and 4 show another modified form of button 10″ according to the invention in which there is provided a collet 23′ made of a resilient material and having a disc-like base 28 with a plurality of spaced leaf spring portions 24′ extending circumferentially from the upper surface of the base 28. Each of the spring portions 24′ is bent radially inwardly to form a projecting lug 29 engageable with the hub 19′ to prevent the latter separating from the anchoring member 12.

Obviously, various modifications and variations of the present invention are possible in light of the above teaching. It is therefore to be understood that within the scope of the appended claims the invention may be practiced otherwise than as specifically described.

What is claimed is:

1. A tack button which comprises:

(a) a button body having a button tack secured to a cylindrical hub;

(b) a tack member non-removably secured to said hub;

(c) an anchoring member adapted to interconnect said button body and said tack member; and (d) a spring member accommodated in said anchoring member and adapted to hold said cylindrical hub resiliently in place with in said anchoring member; said cylindrical hub having one marginal edge tiltably supported in said button back and the opposite marginal edge extending beyond the outer periphery of said hub and tiltably supported on said spring member;

wherein said spring member is in the form of a disc having a plurality of spaced leaf spring portions, each of which is bent radially inwardly to form a projecting lug.

2. A tack button which comprises:

(a) a button body having a button back secured to a cylindrical hub;

(b) a tack member non-removably secured to said hub;

(c) an anchoring member adapted to interconnect said button body and said tack member; and (d) a spring member accommodated in said anchoring member and adapted to hold said cylindrical hub resiliently in place within said anchoring member; said cylindrical hub having one marginal edge tiltably supported in said button back and the opposite marginal edge extending beyond the outer periphery of said hub and tiltably supported on said spring member;

wherein said hub includes a hook at one end thereof, and said anchoring member includes a collet having a through opening dimensioned to loosely receive said hook.

3. A tack button according to claim 2 wherein said cylindrical hub has an inverted truncated cone portion having an annular lug extending beyond the outer periphery of said hub.

4. A tack button according to claim 2 wherein said spring member is in the form of a slitted annular ring.

* * * * *